US005836804A

United States Patent [19]

Tsai

[11] Patent Number: 5,836,804

[45] Date of Patent: Nov. 17, 1998

[54] TRANSMISSION APPARATUS OF A TOY MOTORCYCLE

[76] Inventor: Weh Ho Tsai, 8Fl., No. 113, Yu Jen Rd., Taipei, Taiwan

[21] Appl. No.: 552,416

[22] Filed: Nov. 3, 1995

Related U.S. Application Data

[63] Continuation-in-part of Ser. No. 378,341, Jan. 26, 1995, Pat. No. 5,542,872.

[51] Int. Cl.[6] ..... A63H 17/21

[52] U.S. Cl. ..... 446/440; 446/470

[58] Field of Search ..... 446/440, 437, 446/470, 436, 288, 284, 279–281, 462

[56] References Cited

U.S. PATENT DOCUMENTS 5,139,456 8/1992 Chuang ..... 446/231
5,360,367 11/1994 Ho ..... 446/470

FOREIGN PATENT DOCUMENTS 630644 6/1936 Germany ..... 446/437

*Primary Examiner*—Mickey Yu
*Attorney, Agent, or Firm*—Pro-Techtor International

[57] ABSTRACT

A transmission apparatus of a toy motorcycle, including a transmission mechanism, a transmission casing for enclosing the transmission mechanism, a lifting mechanism, a rearward pushing mechanism and a laterally pushing mechanism. The transmission casing is mounted on a chassis of a housing of the toy motorcycle. The transmission mechanism includes a power source, a reducing gear set driven by the power source and respectively to a driving shaft and driven shaft, and a set of concentrical cams. The transmission mechanism drives a rotary power wheel set which enables the toy motorcycle to run on the ground. The set of cams drive the lifting mechanism, rearward pushing mechanism and laterally pushing mechanism to pivotally open a rear cover and two lateral covers for showing several decorative bodies such as toy helicopter and missiles as well as lifting and rotating the entire toy motorcycle.

8 Claims, 5 Drawing Sheets

TRANSMISSION APPARATUS OF A TOY MOTORCYCLE

CROSS-REFERENCE OF THE PRESENT OF A TOY APPLICATION

The present application is a continue-in-part application of U.S. patent application Ser. No. 08/378,341, Jan. 26, 1995, U.S. Pat. No. 5,542,872.

BACKGROUND OF THE INVENTION

The present invention relates to a transmission apparatus of a toy motorcycle, which is able to pivotally open a rear cover and two lateral covers for showing several decorative bodies such as toy helicopter and missiles as well as lift and rotate the entire toy motorcycle.

A conventional electric toy vehicle only has the functions of running and self-steering and simultaneously emitting a sound and light. Because of lacking versatile actions for the children, such conventional toy vehicle can hardly satisfy the requirements of the children. Therefore, an improved toy vehicle has been developed to create various kinds of special actions for meeting the market requirements. However, such toy vehicle has complicated structure. This results in high cost and high Price which can hardly accepted by common consumers. Therefore, it is necessary to provide a toy vehicle which has simple structure while creating versatile actions to solve the above problem.

SUMMARY OF THE INVENTION

It is therefore a Primary object of the present invention to provide a transmission apparatus of a toy motorcycle, which not only enables the toy motorcycle to run and self-steer, but also drives a lifting mechanism, a rearward pushing mechanism and a laterally pushing mechanism respectively for lifting and rotating the toy motorcycle, pivotally opening rear and lateral covers for showing several decorative bodies such as toy helicopter and missiles. Accordingly, versatile actions of the toy motorcycle are created to achieve a joyful entertaining effect.

It is a further object of the present invention to provide the above transmission apparatus which has simple structure and is easily manufactured at low cost.

The present invention can be best understood through the following description and accompanying drawings, wherein:

BRIEF DESCRIPTION OF THE DRAWINGS

FIG. 5-B is a perspective view of the second laterally pushing member of the present invention;

FIG. 5-C is a sectional view showing the laterally pushing mechanism of the present invention prior to operation; and FIG. 5-D is a sectional view showing the laterally pushing mechanism of the present invention after operation.

DETAILED DESCRIPTION OF THE PREFERRED EMBODIMENT

Figure 1:
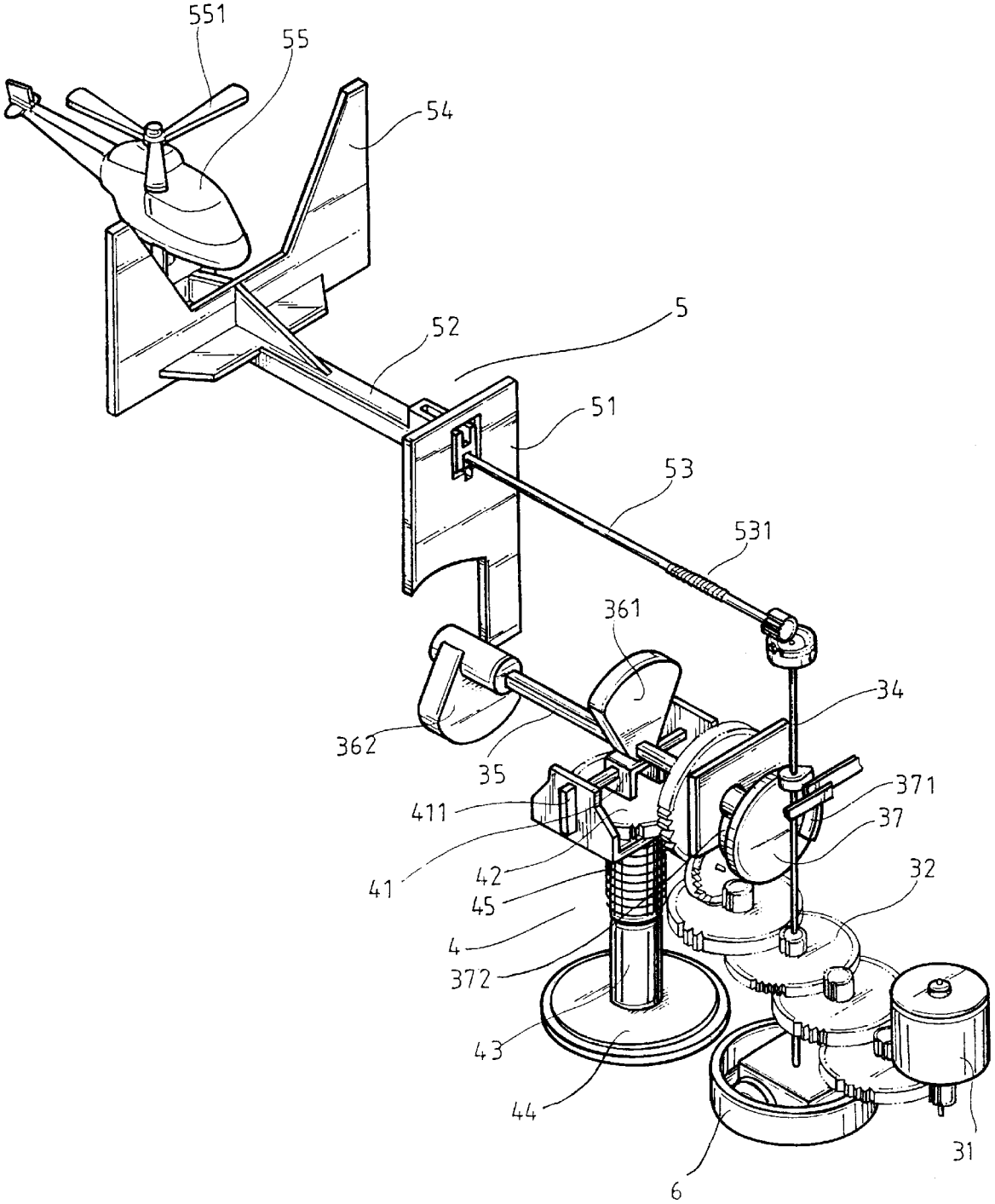
FIG. 1 is a perspective view of the transmission apparatus of the present invention with the transmission casing removed.
Figure 2:
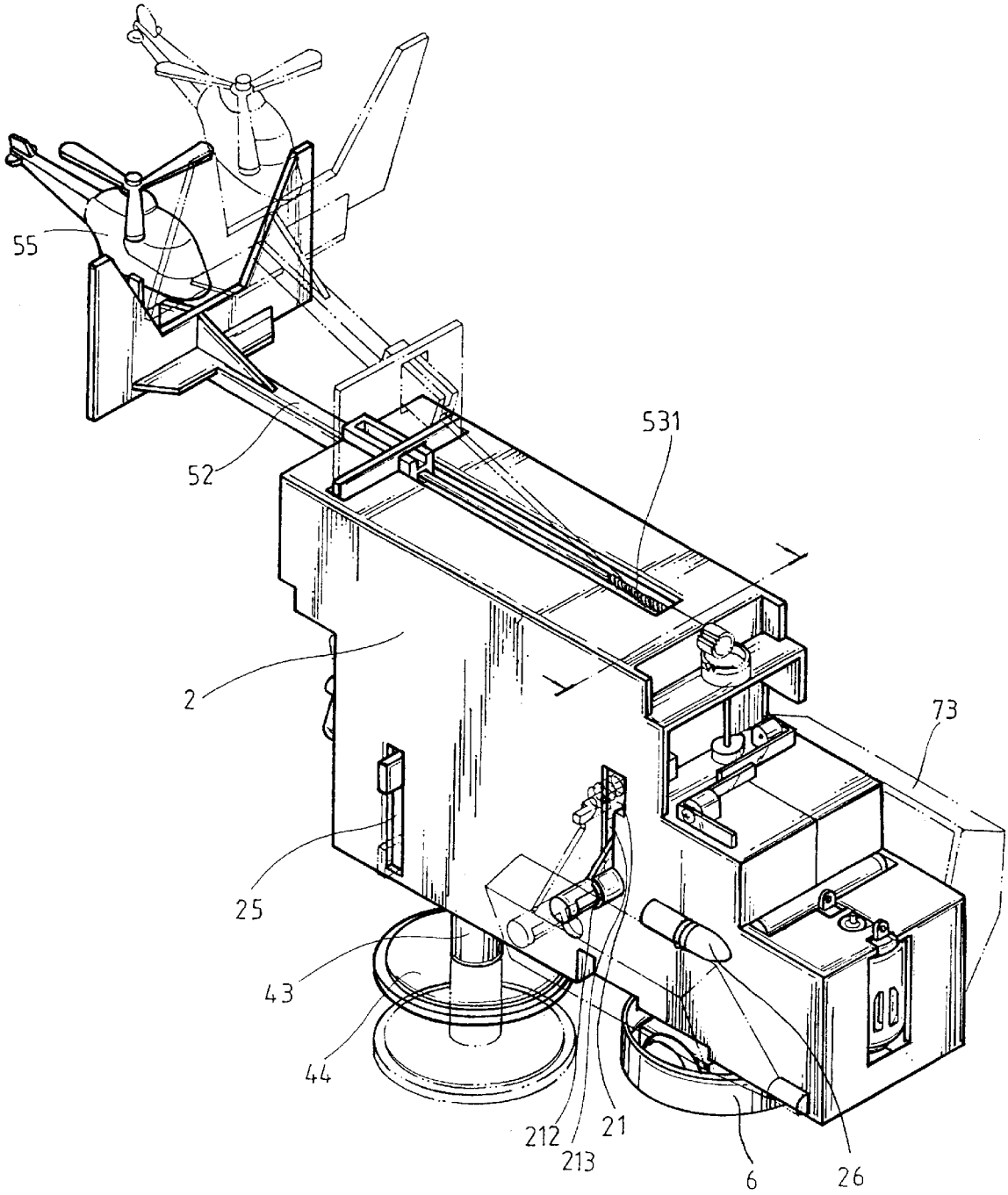
FIG. 2 is a perspective view of entire transmission apparatus of the present invention.
Figure 3:
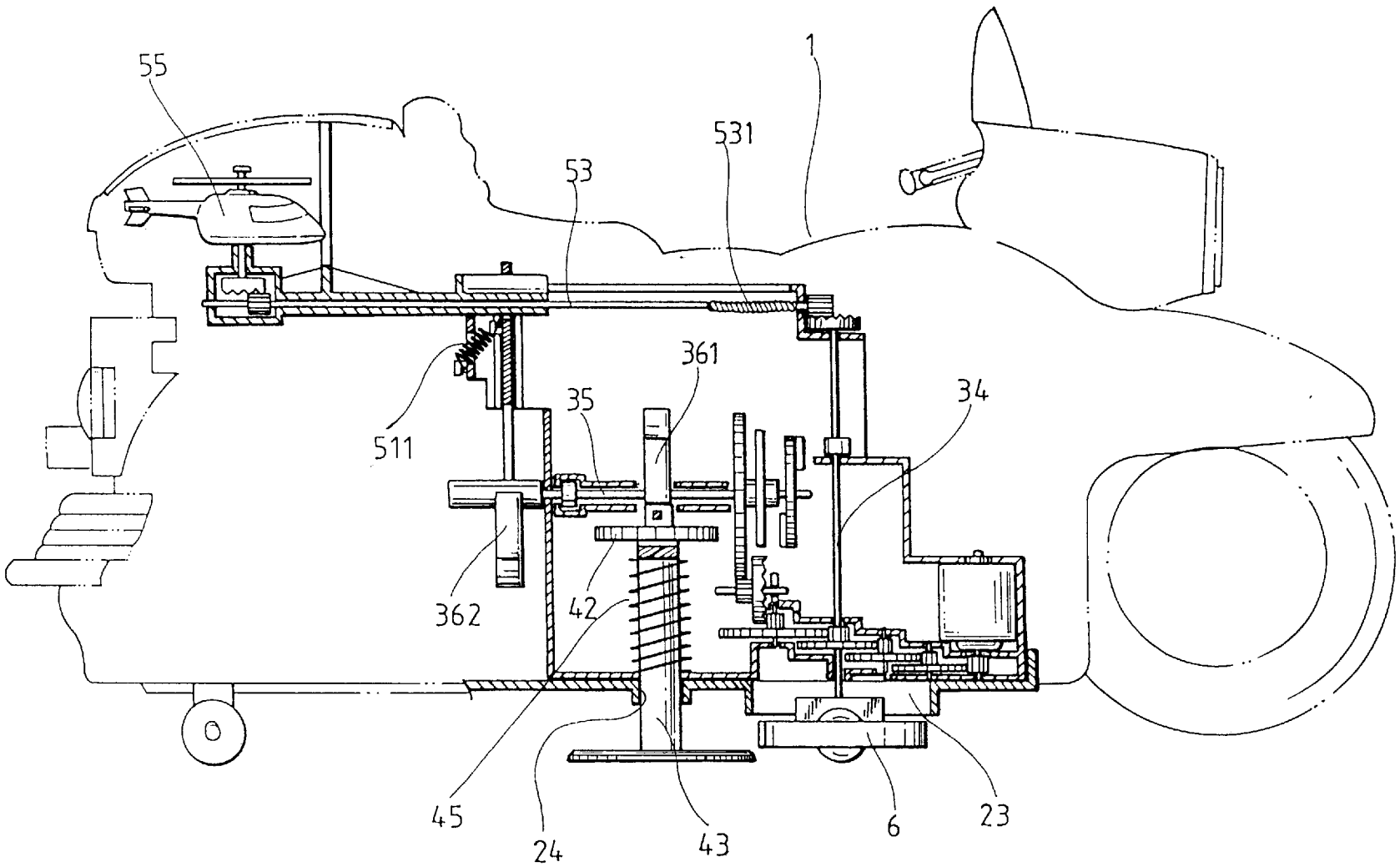
FIG. 3 is a sectional view showing the rearward pushing mechanism and lifting mechanism of the present invention prior to operation.
Figure 4:
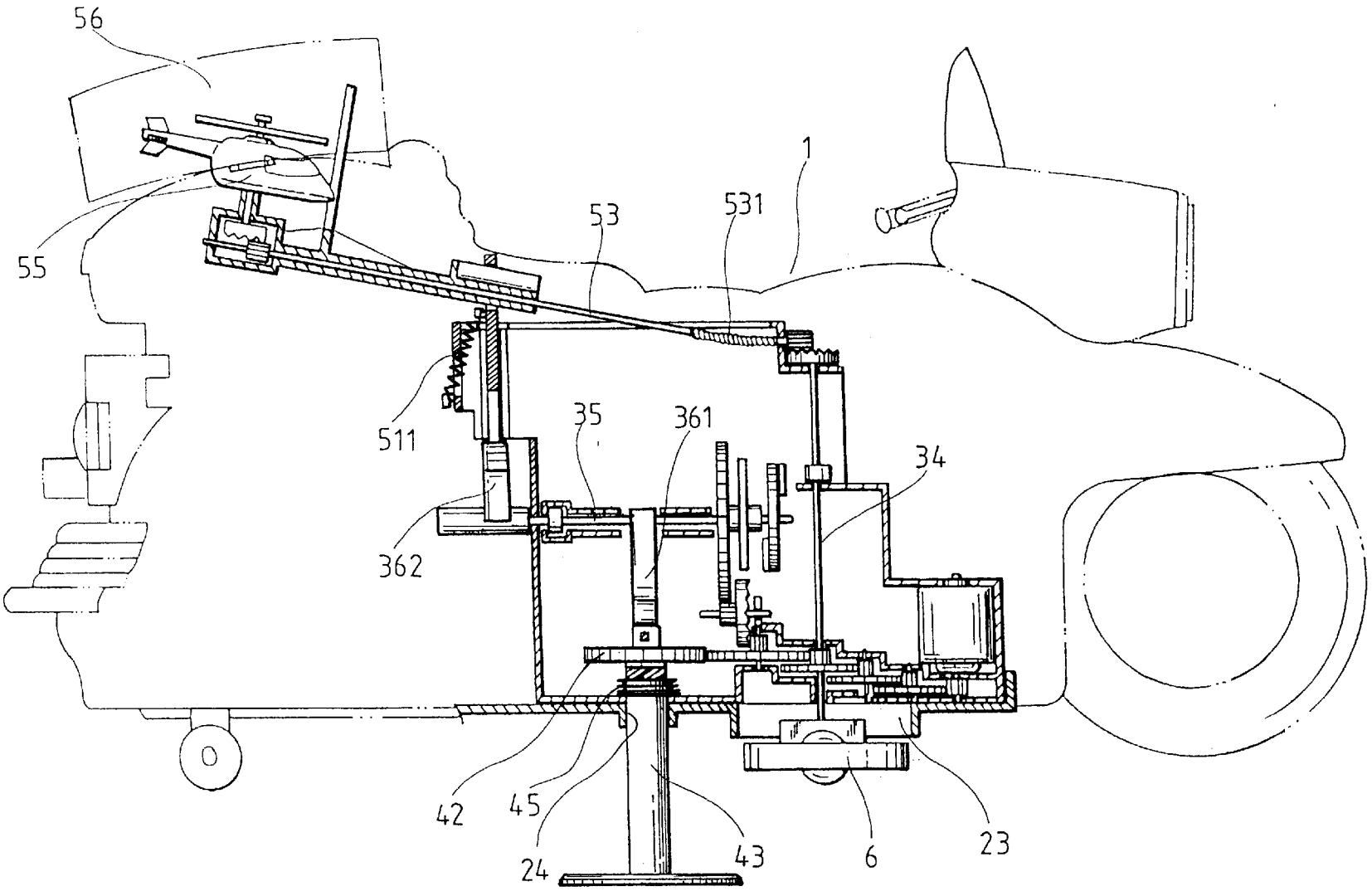
FIG. 4 is a sectional view showing the rearward pushing mechanism and lifting mechanism of the present invention after operation.
Figure 5B:
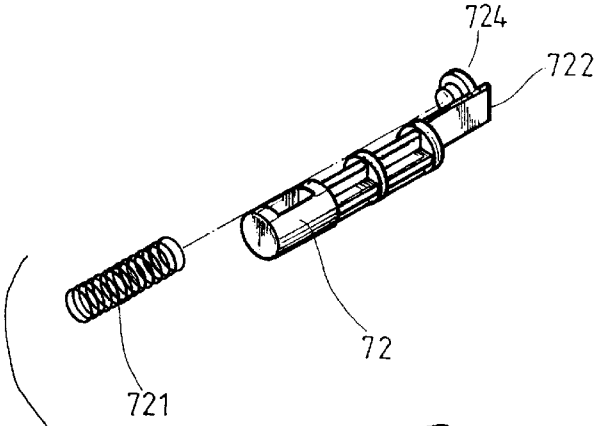
FIG. 5-A is a perspective view of the first laterally pushing member of the present invention.
Figure 5A:
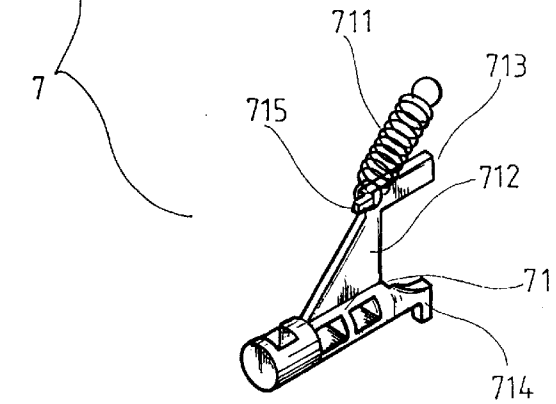
Figure 5D:
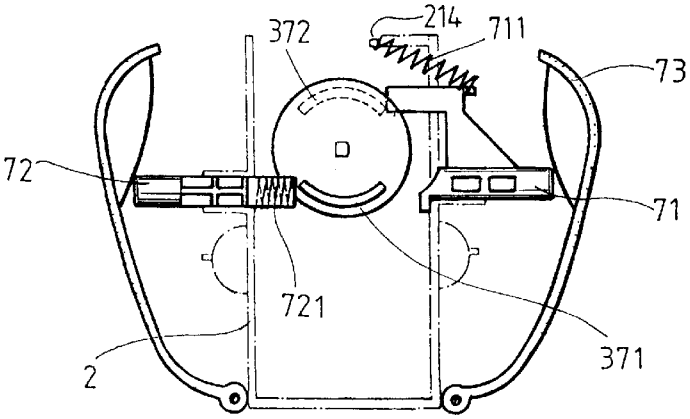
Figure 5C:
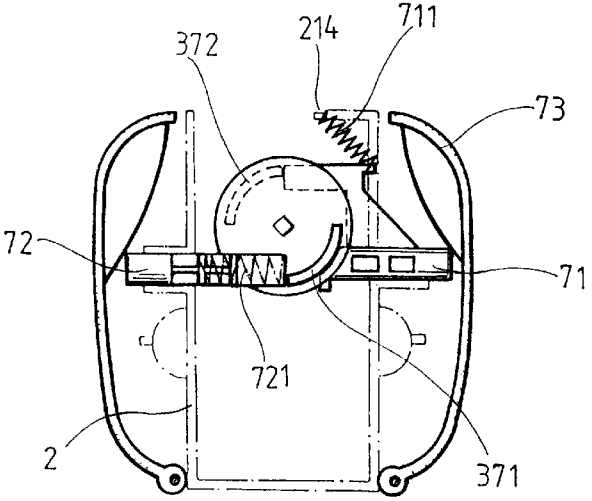

Please refer to FIGS. 1 to 5–4. The present invention mainly includes a transmission mechanism 3, a transmission casing for enclosing the transmission mechanism 3, a lifting mechanism 4, a rearward pushing mechanism 5 and a laterally pushing mechanism 7.

The transmission casing 2 is mounted on a chassis of a housing of the toy motorcycle. A cross-shaped slot 22 is formed on a top face of the transmission casing 2. Two symmetrical lifting guide slots 25 are formed on two lateral sides of the casing 2 near a rear end thereof. Two slots 21, 211 are formed on the lateral sides near a middle portion for laterally pushing members to extend therethrough. Decorative articles such as missiles 26 are disposed on the casing 2 in front of the slots 21, 211. The slot 21 includes a bottom end protruding hole 212, an upward extending guide slot 213 and a top hooking latch 214. An opening 23 is formed on the bottom face of the casing 2 on a front side thereof. A hole 24 is formed behind the opening 23 for a lifting column to extend therethrough.

The transmission mechanism 3 includes a power source 31 connected through a reducing gear set 32 respectively to a driving shaft 34 and driven shaft 35. The bottom end of the driving shaft 34 directly drives a rotary Power wheel set 6 to protrude through the opening 23 for driving the housing 1. The top end of the driving shaft 34 through a flexible section 531 is coupled with a transmission shaft 53 of the rearward pushing mechanism 5. One end of the driven shaft 35 is drivingly coupled with a rotary disk 37, while the other end thereof is disposed with a first cam 361 and a second cam 362 which are 180 degrees different in phase. A front and a rear pushing blocks 371, 372 are respectively disposed on a front and a rear sides of the rotary disk 37.

The lifting mechanism 4 includes a top depression frame 41 which is intermittently depressed by the first cam 361. A driving gear 42 is disposed in the frame for concentrically driving a lifting column 43. The bottom end of the lifting column 43 is disposed with a plane disk seat 44 and a compression spring 45 is disposed between the bottom of the depression frame 41 and the inner face of the bottom of the transmission casing 2. The lifting column 43 protrudes through the hole 24 of the casing 2 under the chassis. Two sliding guide keys 411 are disposed on two lateral walls of the depression frame 41 and slidably received in the lifting guide channels 25 of the casing 2.

One end of the transmission shaft 53 of the rearward pushing mechanism 5 through a flexible section 531 is coupled with the driving shaft 34. The other end of the transmission shaft 53 extends into a lifting rod 52. One end of the lifting rod 52 through a rearward pushing board 51 is coupled with the second cam 362. The other end thereof is disposed with a decorative toy helicopter 55. A pushing board 54 is disposed on two sides of the helicopter 55. The end section of the transmission shaft 53 extends into the lifting rod 52 and coupled with a propeller 551 of the helicopter 55.

The laterally pushing mechanism 7 includes a first and a second laterally pushing members 71, 72 protruding respectively through the slots 21, 211 of the transmission casing 2. The second laterally pushing member 72 is substantially cylindrical column, having a rear driven end 722. The front ( or rear ) pushing block 371, 372 of the rotary disk 37 pushes the driven end 722 so as to extend the second laterally pushing member 72 outward. A second restoring spring 721 is confined between and compressed by the inner lateral wall of the casing 2 and a pushing plate 724. The first laterally pushing member 71 also has a cylindrical column section protruding through the bottom end protruding hole 212 of the slot 21. The first laterally pushing member 71 has a reverse hook section 714 at rear end for hooking and locating the inner lateral wall of the casing 2. A guide plate 712 inclinedly extends from upper side of the column section, having a rear driven end 713 to be pushed and outward extended by the rear ( or front ) pushing block 372, 371. The front end of the guide plate 712 is disposed with a hooking latch section 715 on which one end of the first restoring spring 711 is hooked and latched. The other end of the first restoring spring 711 is hooked on the hooking latch section 214 of the slot 21.

When the power source 31 is switched on, the reducing gear set 32 is activated to drive the driving shaft 34 and the driven shaft 35. The bottom end of the driving shaft 34 directly drives the rotary power wheel set 6, whereby the housing 1 can run all over. The top end of the driving shaft 34 through the transmission shaft 53 drives the propeller 551 of the helicopter 55. Simultaneously, the driven shaft 35 is rotated to rotarily drive the first and second cams 361, 362 and the rotary disk 37. The first and second cams 361, 362 intermittently depress the depression frame 41 and the rearward pushing board 51. The depression frame 41 operates to make the lifting column 43 via the plane disk 44 lift the housing 1. When the sliding guide keys 411 slide downward to the lower dead ends, the driving gear 42 meshes with the reducing gear set 32 to rotate the housing 1. Thereafter, the first cam 361 gradually rotates away from the depression frame 41 and the housing 1 is supported by the compression spring 45 to slide down. At this time, the rearward pushing board 51 is pushed by the second cam 362 to drive the lifting rod 52 upward. The pushing board 54 pivotally opens the rear cover 56 to show the toy helicopter 55. When the second cam 362 slides away from the rearward pushing board 51, the rearward pushing board 51 drives the helicopter 55 and the Pushing board 54 downward with the rear cover 56 closed. When the rotary disk 37 rotates, the front and rear pushing blocks 371, 372 respectively abut against the driven ends 713, 722 of the first and second laterally pushing members 71, 72. At this time, the first and second laterally pushing members 71, 72 pivotally open the lateral covers 73 to show the decorative bodies 26. After the front and rear pushing blocks 371, 372 slide away from the driven ends 713, 722, the first and second laterally pushing members 71, 72 are restored by the first and second restoring springs 711, 721.

The above description and accompanying drawings are used to illustrate one embodiment of the Present invention, not intended to limit the scope thereof. Any modification of this embodiment should fall within the scope of the present invention.

What is claimed is:

1. A transmission apparatus of a toy motorcycle, comprising:

a transmission mechanism, a transmission casing for enclosing the transmission mechanism, a lifting mechanism, a rearward pushing mechanism and a laterally pushing mechanism, wherein:

the transmission casing is mounted on a chassis of a housing of the toy motorcycle;

the transmission mechanism includes a power source connected through a reducing gear set respectively to a driving shaft and a driven shaft, a bottom end of the driving shaft directly driving a rotary power wheel set, a top end of the driving shaft being coupled with a transmission shaft of the rearward pushing mechanism, one end of the driven shaft being coupled with a rotary disk, while the other end of the driven shaft is disposed with a first cam and a second cam, a front pushing block and a rear pushing block being respectively disposed on a front and a rear side of the rotary disk;

the lifting mechanism includes a lifting column extending outward and downward from the bottom of the transmission casing, a depression frame disposed at a top end of the lifting column and intermittently depressed by the first cam, and a plane disk disposed at a bottom end of the lifting column, the plane disk extending outward and downward when depressed to lift the transmission casing and when released from the depression, the plane disk is restored to lower the transmission casing;

one end of a transmission shaft of the rearward pushing mechanism is coupled with the driving shaft, while the other end of the transmission shaft extends into a lifting rod, one end of the lifting rod being coupled with a rearward pushing board, while the other end thereof being disposed with a decorative body and a pushing board, the second cam pushing the rearward pushing board to raise the lifting rod and thereby raise the pushing board so as to pivotally open a rear cover so as to show the decorative body;

the laterally pushing mechanism at least includes two laterally pushing members protruding respectively through two slots on two sides of the transmission casing, when pushed by the front and rear pushing blocks, the laterally pushing members laterally extending outward to pivotally open two lateral covers.

2. A transmission apparatus as claimed in claim 1, wherein:

a cross-shaped slot is formed on a top face of the transmission casing and two symmetrical lifting guide slots are formed on two lateral sides of the casing near a rear end thereof, two slots being formed on the lateral sides near a middle portion for the laterally pushing members to extend therethrough, an opening being formed on the bottom face of the casing on a front side thereof for the rotary power wheel set to extend therethrough, a hole being formed behind the opening for the lifting column to extend therethrough.

3. A transmission apparatus as claimed in claim 2, wherein:

a first one of the slots formed on two lateral sides of the casing includes a bottom end protruding hole, an upward extending guide slot and a hooking latch section disposed at the top wall of the guide slot.

4. A transmission apparatus as claimed in claim 1, wherein:

the first and second laterally pushing members of the laterally pushing mechanism protrude respectively through the slots formed on the two lateral sides of the transmission casing, the second laterally pushing member being substantially cylindrical column, having a rear driven end, the front or rear pushing block of the rotary disk pushing the driven end so as to extend the second laterally pushing member outward, a second restoring spring being confined between and compressed by an inner lateral wall of the casing and a pushing plate, the first laterally pushing member also having a cylindrical column section protruding through the bottom end protruding hole of the slot, the first laterally pushing member having a reverse hook section at rear end for hooking and locating the inner lateral wall of the casing, an inclined guide plate extending from an upper side of the column section, having a rear driven end to be pushed and outward extended by the rear or front pushing block, the front end of the guide plate being disposed with a hooking latch section on which one end of a first restoring spring is hooked and latched, the other end of the first restoring spring being hooked on a hooking latch section of the slot.

5. A transmission apparatus as claimed in claim 1, wherein:

the lifting mechanism includes a top depression frame, a driving gear is disposed in the frame for concentrically driving the lifting column to extend out of the transmission casing, the bottom end of the lifting column being disposed with a plane disk seat, and a compression spring being disposed between the bottom of the depression frame and the inner face of the bottom of the transmission casing.

6. A transmission apparatus as claimed in claim 5, wherein:

when the lifting mechanism is depressed, the driven gear meshes with the reducing gear set to rotate the housing.

7. A transmission apparatus as claimed in claim 1, wherein:

the transmission shaft extends into the lifting rod to be coupled with a propeller of the decorative body to rotate the propeller.

8. A transmission apparatus as claimed in claim 1, wherein:

the first and second cams are 180 degrees out of phase.

* * * * *